US007690070B2

(12) United States Patent
Jung

(10) Patent No.: US 7,690,070 B2
(45) Date of Patent: Apr. 6, 2010

(54) BI-POLE CLEANING DEVICE

(76) Inventor: Man-Young Jung, 2750 E. Washington Blvd., Ste 150, La Canada, CA (US) 91107-6201

( * ) Notice: Subject to any disclaimer, the term of this patent is extended or adjusted under 35 U.S.C. 154(b) by 1078 days.

(21) Appl. No.: 11/233,800

(22) Filed: Sep. 24, 2005

(65) Prior Publication Data

US 2007/0071540 A1 Mar. 29, 2007

(51) Int. Cl.
*A46B 11/00* (2006.01)
*A46B 5/02* (2006.01)

(52) U.S. Cl. ..... 15/144.1; 15/144.2; 401/270

(58) Field of Classification Search ..... 15/144.1, 15/144.2; 401/270

See application file for complete search history.

(56) References Cited

U.S. PATENT DOCUMENTS

| | | | | | |
|---|---|---|---|---|---|
| 698,849 | A * | 4/1902 | Ouellette | 30/171 |
| 1,548,452 | A * | 8/1925 | Fyhrie | 404/97 |
| 1,962,675 | A * | 6/1934 | Zentmyer | 15/105 |
| 2,021,158 | A * | 11/1935 | Stearns | 15/145 |
| 2,614,281 | A * | 10/1952 | Clark | 15/160 |
| 2,764,774 | A * | 10/1956 | Belsky et al. | 15/228 |
| 4,256,416 | A * | 3/1981 | Bishop | 404/119 |
| 5,016,319 | A * | 5/1991 | Stigen | 16/426 |
| 5,115,536 | A * | 5/1992 | Jarvis | 15/235.8 |
| 5,319,824 | A * | 6/1994 | Cook, III | 15/160 |
| 5,406,671 | A * | 4/1995 | Green | 15/235.5 |
| 5,507,066 | A * | 4/1996 | Zulick | 15/230.11 |
| 5,605,415 | A * | 2/1997 | Shamblin | 404/118 |
| 5,611,102 | A * | 3/1997 | Lesinsky et al. | 15/235.5 |
| 5,921,600 | A * | 7/1999 | Lucas | 294/58 |
| 6,488,442 | B2 * | 12/2002 | Boudreaux, Sr. | 404/97 |

* cited by examiner

*Primary Examiner*—Randall Chin
(74) *Attorney, Agent, or Firm*—Clement Cheng

(57) ABSTRACT

A bi-pole cleaning handle device for universal use with conventional cleaning instruments is provided. The device has a first side pole and a second side pole pivoted by swivel connectors side supports, respectively. Extending from the side supports is a base generally shaped as a rectangular shell to hold a cleaner head, which may be selected from a sponge block, brush, scrub head, squeegee, cleaning pad and any other suitable cleaning material. The fist side pole has a handle at its top and the second side pole has a similar handle. Each handle is angled with respect to the axis of its pole and has a grip on one side. This angle is set for the converging function of the bi-pole handle of the present invention as well as ergonomics in holdings by the user. The cross section of the grip is semicircular. The side poles and the handles can be either manipulated by left and right hands independently or by both hands simultaneously with the handle in unity.

8 Claims, 7 Drawing Sheets

BI-POLE CLEANING DEVICE

BACKGROUND OF THE INVENTION

A. Field of the Invention

The present invention relates to cleaning tools, and more particularly to a cleaning twin pole handle.

B. Description of the Prior Art

Cleaning tools such as mops and sweepers require handles, which enable their cleaning head to be pushed and pulled over surfaces. Typically, a broom's handlebar is fixed to a resolute point on a cleaning head bearing a downward facing brush or disposable cloth. Enhanced handles are designed to pivot in the center of the head, allowing for additional directional control and force of the broom during the cleaning session. However, such currently available cleaning devices still make cleaning around house or building a labor intensive and tiresome job, to skilled janitorial professionals and occasional family sweepers alike.

Innovative ideas have arisen to alleviate this janitorial hardship, as cited in U.S. Pat. No. 6,742,222 to Furr-Britt, et al. whereby a dual-handle attachment for an appliance is suggested. According to the '222 patent, the dual handle attachment is for a floor appliance (i.e. vacuum cleaner, large push broom, mop, squeegee, etc.) which allows the user to manipulate or maneuver the appliance using generally symmetrical upper body, arm, wrist, and hand forces and movements. This thereby eliminates the need for asymmetrical wrist twisting, while also reducing the strength required for device manipulation by means of single arm and hand. This attachment comprises a single central bracket that attaches to a conventional appliance's single handlebar, and a left and right handgrip extending adjustably from the central bracket forming a "V" shape. The two mentioned handgrips may be pivotally adjusted as the user desires, and may also be interchanged for handgrips having different desired shapes or configurations. This dual handle attachment essentially branches from the top of the appliance handlebar, creating a dual-grip option. The original handlebar and the left and right side handle attachments all extend in parallel, i.e. invariable zero degree, to the handlebar, which in turn limits each of the side handle attachments to rotate about its own axis.

Because the handle is attached at a remote location, near the user's hands and away from the cleaning head on the floor, the hands' push and pull forces from the left and right sides are consequently merged into the central handlebar. This essentially results in creating no substantial advantage over a conventional single handlebar's directional control of the cleaning head. Furthermore, the heavyweight attachment dramatically adds to the weight of the appliance, creating an adverse affect on the mobility and ability to easily manipulate or maneuver the cleaning tool.

In order to provide a direct control of force at the cleaning instrument's interface, as well as alleviate the appliances' inherent mobility intricacies, an additionally enhanced handlebar design is necessary.

SUMMARY OF THE INVENTION

In view of the foregoing, a first object of the present invention is to provide a double free swivel handle system for cleaning instruments where swivels are made to occur on the top opposite ends of the cleaning head of the instrument for a direct transmission of directional control by the hands of the user.

A second object of the present invention is to provide a double-swivel handle system having two handle components that may be converged into a single grip for both hands to exert a concentrated force of push and pull against a harder job.

A third object of the present invention is to provide a universal dual-swivel handle device that can be equally and immediately applied to heavy duty instruments like push brooms and mops, as well as floor sweepers with solution ejection, paint scrapers, and light squeegees.

The floor sweeper, according to the present invention, has a first side pole and a second side pole pivoted by swivel connectors to a first side support and second side support, respectively.

The first pole has a handle at its top and the second pole has a similar handle. Each handle is angled with respect to the axis of its pole and has a grip on one side. This angle is set to assist in the converging function of the bi-pole handle of the present invention, as well as user ergonomics. The cross section of the grip is semicircular. The other flat side of the handles may be textured in a pattern for enhancing frictional engagement between the two poles when they are in joint hold. In unity, the handle provides a round cross section and a frictional grip on the outer surfaces.

The side poles and the handles together constitute a bi-pole handle that can be manipulated either by the left and right hands independently or by both hands simultaneously with the handle in unity.

The poles of the cleaning handle are pivotally fixed to the appliance base by a fastening means comprising a ball joint retainer. This particular retainer includes an upper housing member with several screw holes and a ball housing located centrally of the housing member. The ball housing protrudes upwardly from the housing member and has an opening through which a ball joint is inserted. The ball joint is provided at its lower end with a ball member, which is retained by the ball housing at its upper round area and the support at its bottom. The support may have a concave area to receive the bottom of the ball member. When the ball joint assembly is attached to the support by screws, it provides a threaded tip for fastening with the pole with a threaded bore at its bottom end. A metal insert for reinforcement may also provide such bore. The fastening means can be made of metal or plastic.

The second embodiment of the bi-pole handle of the present invention has an integral solution distribution system, which eliminates the need for carrying a separate supply of cleaning solution. In addition to the primary structure of the bi-pole handle with a pair of poles, a floor sweeper has a base shaped to contain cleaning solution at both sides where the poles are fixed. Container sections are adapted to support the poles at their outer top surfaces through the ball joint and housing. Each container section has interior walls that define the space for cleaning solution, and is enclosed by a bottom plate. The compartments are accessible through a raised top opening, and a flexible lid member is installed to fit around the opening to assist in ease of opening and closing each container section.

The solution stored in the container section is channeled to a floor sweep member by a valve that acts with a bias spring on the bottom plate. A pulling cable is connected to an actuation lever fastened next to a grip on the pole-top, which also activates the valve on the other container section. The sweep member contains a pair of liquid channels at both sides that receive the solution supplied from above container sections and distributes it to the floor area. The present invention also provides a third embodiment with a variation to the solution container, which is aligned with each pole member of the bi-pole cleaning handle.

DETAILED DESCRIPTION OF THE PREFERRED EMBODIMENT

Figure 1:
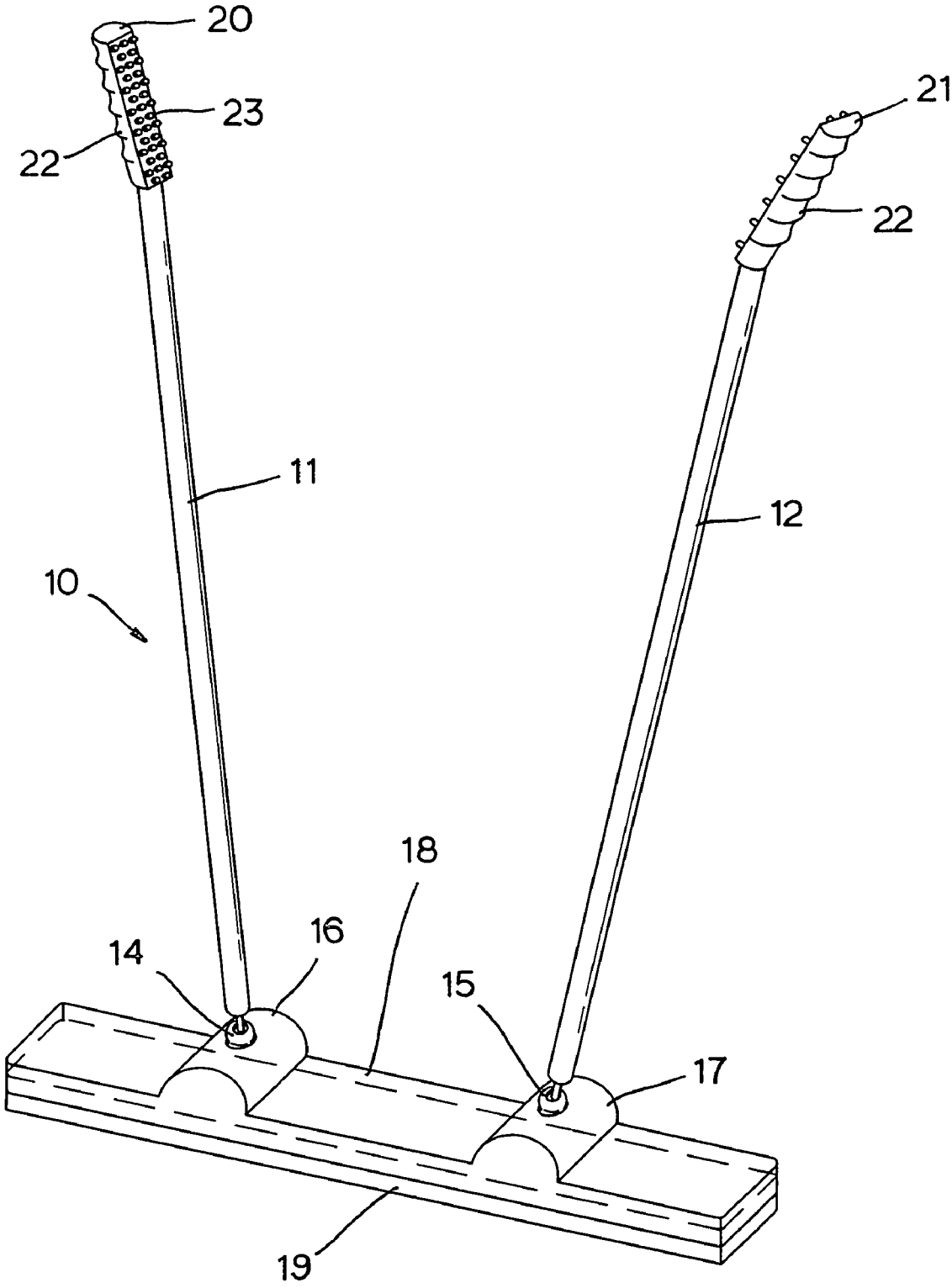
FIG. 1 is a perspective view of a bi-pole cleaning handle connected to a floor sweeper according to a first embodiment of the present invention.

Referring to FIG. 1, the floor sweeper generally denoted as numeral 10 has a first side pole 11 and a second side pole 12 pivoted by swivel connectors 14 and 15 to a first side support 16 and second side support 17, respectively.

Extending from the side supports is a base 18 generally shaped as a rectangular shell to hold a cleaner head 19, which may be selected from a sponge block, brush, scrub head, squeegee, cleaning pad, and any other suitable cleaning material.

In its simpler form, the floor sweeper may have a brush head to replace the supports 16 and 17 and base 18. The inventive bi-pole handle is compliant with a brush head of a general type consisting of a block or plate with fibers, although it is readily adaptable to other cleaning instruments that require a stick or handle. The two side poles 11 and 12 may be attached to a flat top surface of the brush via a pair of universal joints, which are detailed below.

The pole 11 has a handle 20 at its top, and the other pole 12 has a similar handle 21. Each handle is angled with respect to the axis of its pole and has a grip 22 on one side. This angle is set to assist in the converging function of the bi-pole handle of the present invention, as well as user ergonomics. The cross section of the grip 22 is semicircular. The other flat side of the handles may be textured in a pattern 23 for enhancing frictional engagement between the two poles when they are in joint hold. In unity, the handle 24 provides a round cross section and a frictional grip on the outer surfaces. A variety of engagement means can be used for connecting the grips. One may use an elastic band securing the grips together. Clips, metal loops, hook and loop tape, locking pins or other commercially available hardware, can also secure the grips.

Figure 2:
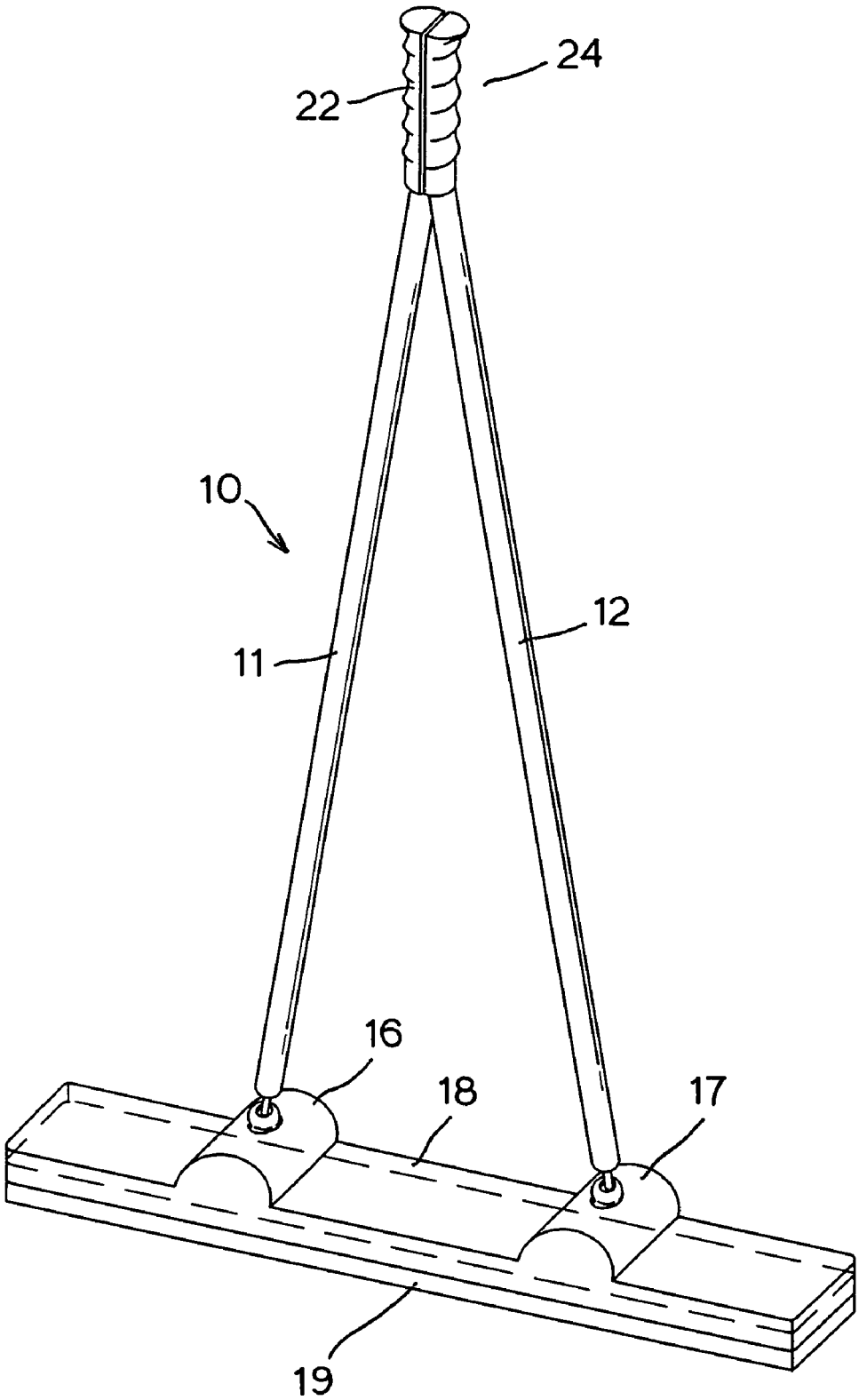
FIG. 2 is a perspective view of the bi-pole cleaning handle of FIG. 1 showing the two pole components are converged into a unit.

The side poles 11 and 12 and the handles 20 and 21 together constitute a bi-pole handle 24, which can be either manipulated by left and right hands independently or by both hands simultaneously with the handle 24 in unity as shown in FIG. 2. This versatility is purely to the advantage to the cleaning person who may have a balanced and precise control over which spot is to be swept at certain push or pull of the sweeper 10. The ability to precisely control saves lost labor and time for a faster cleaning task.

Specifically, the ability to control the opposite sides of the cleaning head by alternately pushing the poles in constantly changing postures frees the conventional rigid posture that a cleaner must have with a single pole. This ergonomically sound improvement eliminates a significant amount of fatigue experienced by the cleaner, and can thus potentially reduce work-related injuries caused by extended hours of cleaning work. The invention also provides an even and concentrated cleaning force by requiring the cleaner to hold the joined poles together, as needed.

Figure 3:
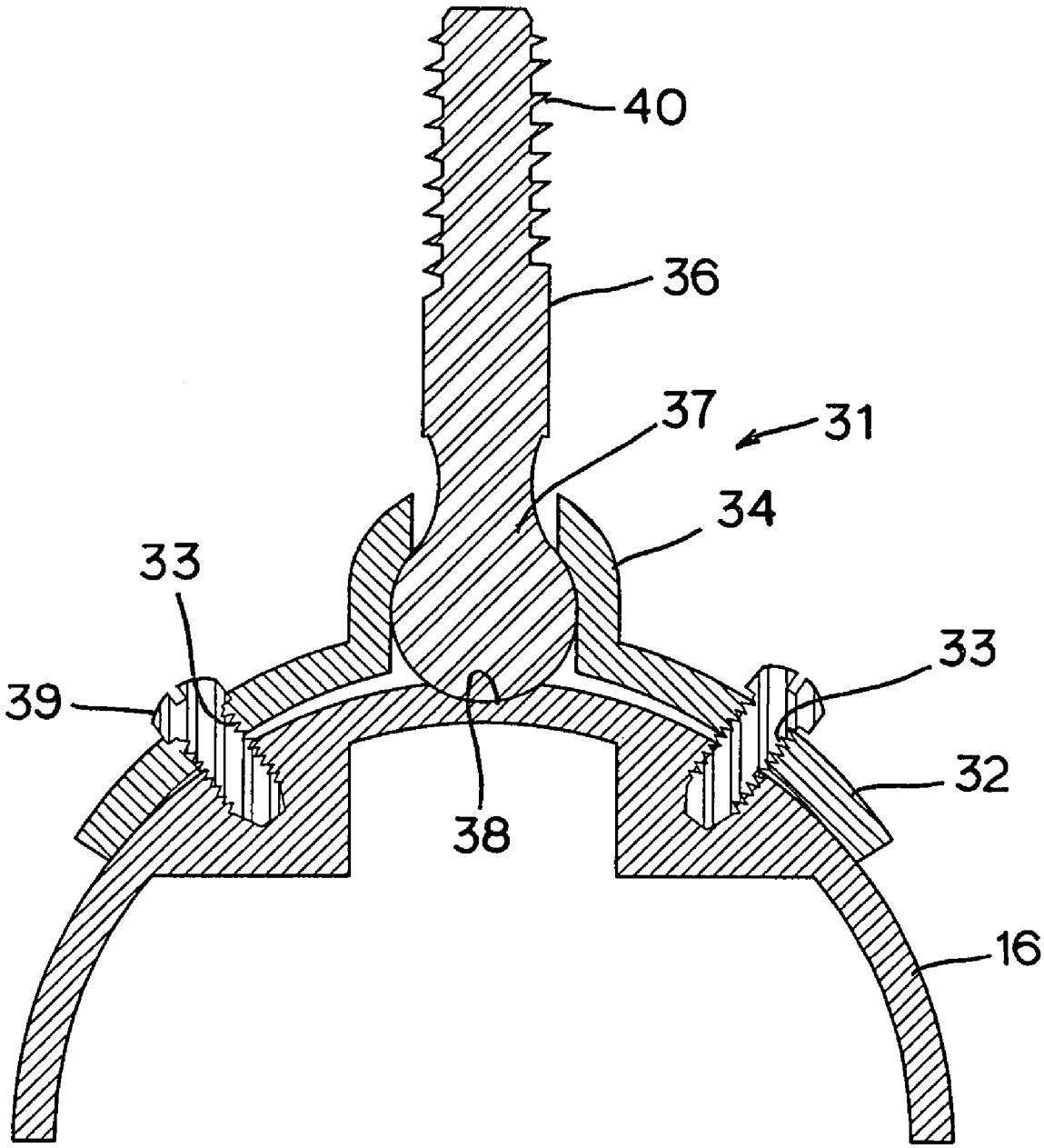
FIG. 3 is a cross sectional view of a ball joint system of the bi-pole handle of the present invention.

The poles of the cleaning handle 24 are pivotally fixed to the base by a fastening means as shown in FIG. 3. The fastening means comprise a ball joint retainer 31 that includes an upper housing member 32 with a number of screw holes 33 and a ball housing 34 located centrally of the housing member 32. The ball housing 34 protrudes upwardly from the housing member 32 and has an opening through which a ball joint 36 is inserted. The ball joint 36 is provided at its lower end with a ball member 37 retained by the ball housing 34 at its upper round area and by the support 16 at its bottom. The support 16 may have a concave area 38 to receive the bottom of the ball member 37. When the ball joint assembly 31 is attached to the support 16 by screws 39, it provides a threaded tip 40 for fastening with the pole 11 with threaded bore at its bottom end. A metal insert for reinforcement may also provide such a bore.

The metal screws 39 are readily available while the fastening means can be made of metal or plastic.

Figure 4:
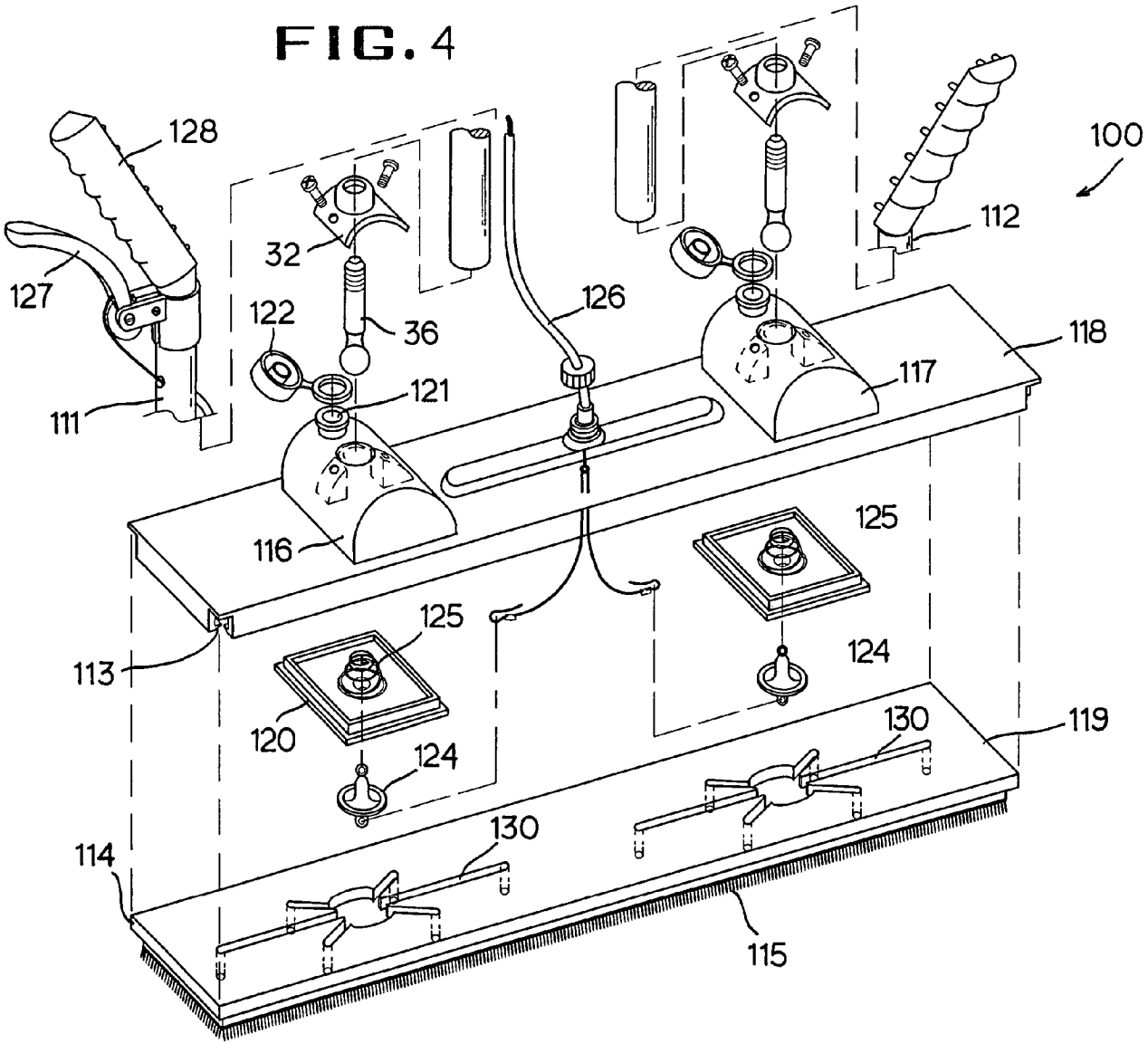
FIG. 4 is an exploded view of a push broom with solution supplies and supports for the bi-pole handle according to a second embodiment of the invention.

FIG. 4 illustrates a second embodiment of the bi-pole handle of the present invention having an integral solution distribution system, eliminating the need for carrying a separate supply of cleaning solution. In addition to the primary structure of the bi-pole handle with a pair of poles 111 and 112, a floor sweeper 100 has a base 118 shaped to contain cleaning solution at both sides where the poles 111 and 112 are fixed. Container sections 116 and 117 are adapted to support at their outer top surfaces the poles 111 and 112 through the ball joint 36 and housing 32 as shown in FIG. 3. Each of the container sections has interior walls that define the space for the solution, and is enclosed by a bottom plate 120. It is accessible through a raised top opening 121. A flexible lid member 122 is installed to fit around the opening 121 for easy opening and closing of each container section.

The solution stored in the container section 116 is channeled to a floor sweep member 123 via a valve 124 that acts with a bias spring 125 on the bottom plate 120 by a pulling cable 126 connected to a pole-top actuation lever 127 fastened next to a grip 128 which also activates the valve 124 on the other container section 117. The sweep member 123 is provided with a pair of liquid channels 130 at both sides for receiving solution supplied from the container section above to distribute the same downwardly to act on the floor to clean.

Figure 5:
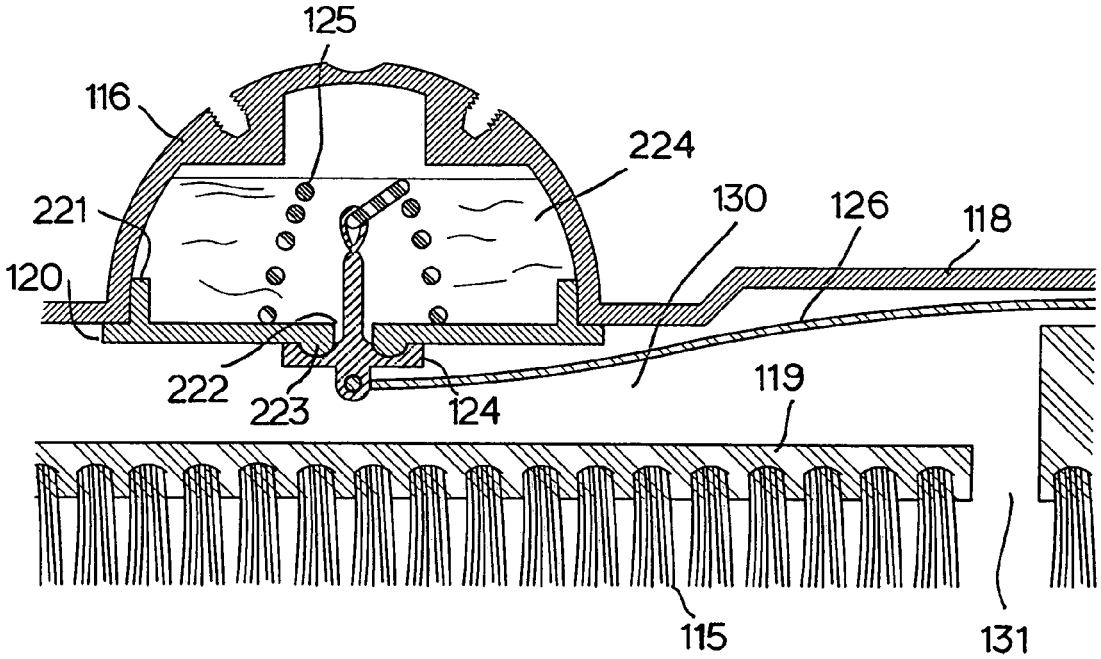
FIG. 5 is a cross sectional view of a liquid supply and support at a side in the push broom of FIG. 4.
Figure 6:
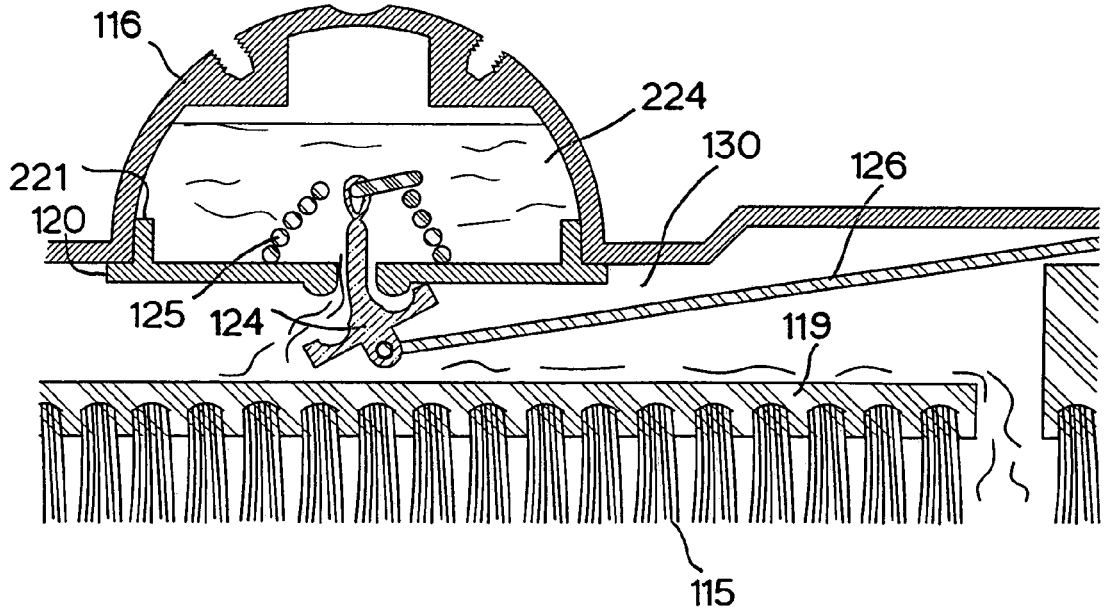
FIG. 6 is a detailed view of a valve control in the supply channel of cleaning solution.
Figure 7:
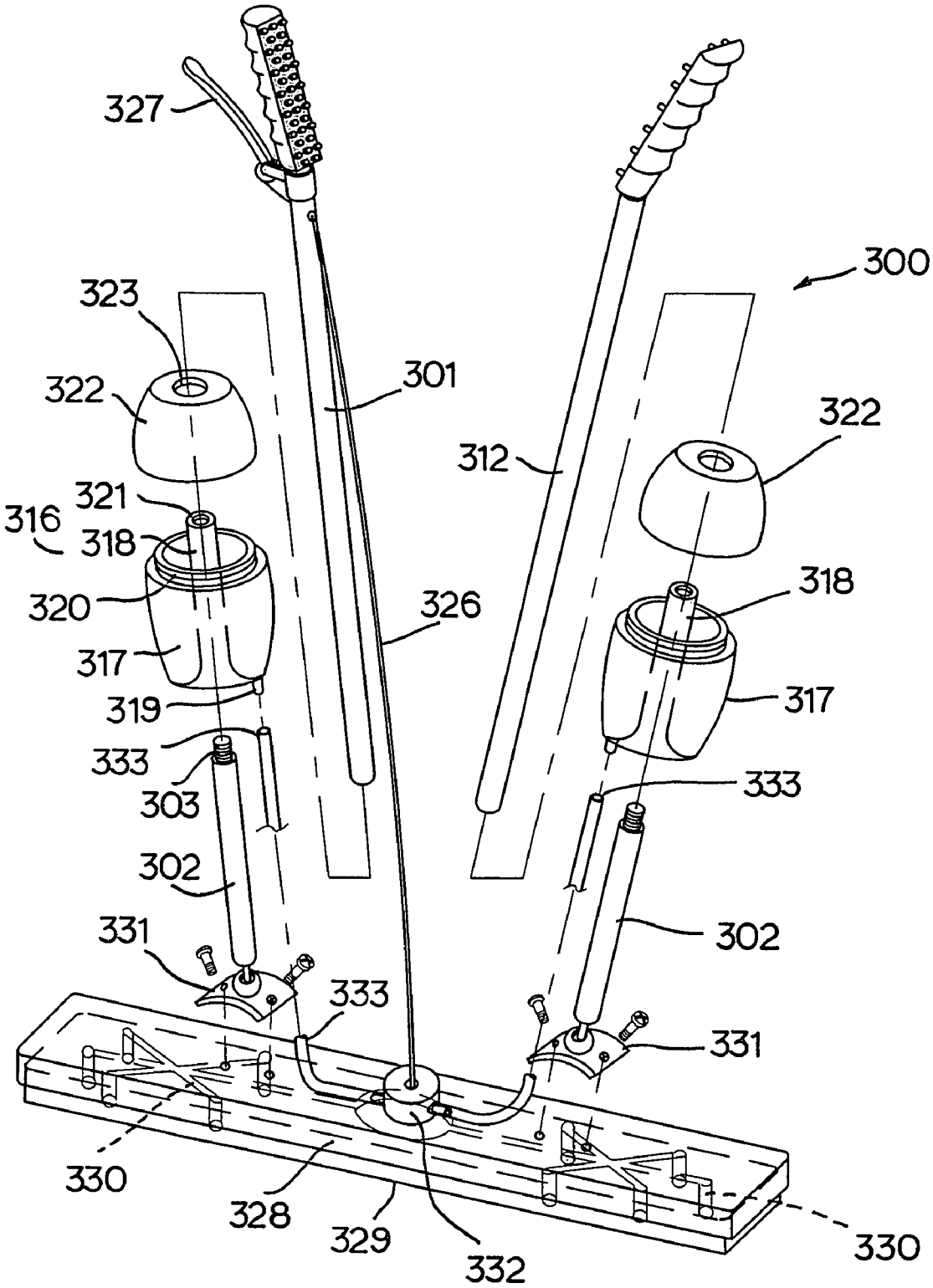
FIG. 7 is a perspective view of a bi-pole cleaning handle having a liquid supply on each pole component according to a third embodiment of the present invention.

FIG. 5 shows in cross section the liquid container 116 with a bottom closure made by the bottom plate 120 and the spring-biased valve 124. The bottom plate 120 is press fit at upright walls 221 into the underside of the container 116. The bottom plate 120 has a central opening 222 with a convex seat 223 onto which the matching shape of the valve 124 is biased in sealing engagement so that the cleaning solution 224 is stored until the cable 126 pulls the valve 124 down to crack open the container 116 which is shown in FIG. 6. In the block 119 is shown a horizontal solution channel 130 connected to a vertical channel 131, which is open to atmosphere. Multiple of these channels may be formed in the block 119 in a radial pattern as shown in FIG. 4. FIG. 7 shows a third embodiment of the bi-pole floor sweeper 300 with a different solution container 316. Here, a pole member comprises a top pole section 301 and a low pole section 302 having a threaded end 303, which is threaded into the bottom end of the top pole section 301 with the container 316 straddling over the low pole section 302. The pole member also has a top pole section 312 at the other side for connection with its own low pole section 302 holding another container 316 in cooperation therebetween. The container 316 includes a cylindrical body 317 and a central sleeve 318 that forms the bottom of the container 316 and extends along the axis of the body 317. The sleeve 318 has at its bottom an outlet 319 for the solution to be supplied.

The body 317 has at its top edge an outer thread 320 while the central sleeve 318 may end above or below the top edge of the body 317 where the threaded engagement between the top and low pole sections 301 and 302 occurs. A shoulder 321 at the end of the sleeve 318 is wedged between the two pole sections upon their engagement and held there in line with the pole assembly. The container 316 also has a lid 322 with an opening 323 formed centrally to pass the top pole section 301 for encounter with the low pole section 302. The lid 322 may be threaded onto the body 317. For later fill ups, the lid 322 may by rotated about the pole section 301 away from the body 317 to open the same.

A similar ball joint retainer 331 to the ones as used in the sweeper 100 pivotally holds the low pole section 302 on each side of the base 328. Also, the cleaner head 329 has solution channels 330 formed on its top surface.

In the center of the base 328 a valve block 332 is attached and also connected to a pole-top lever 327 via a pull cable 326. A pair of flexible tubes 333 is connected between the outlets 319 of the containers 316 and the valve block 332 respectively so that a user can control the supply of the solution from both containers 316 to the floor. Single set of pull cable 326 and lever 327 are shown for easy reading of the drawing although another set of cable and lever may be installed at the other pole component in parallel.

Figure 8:
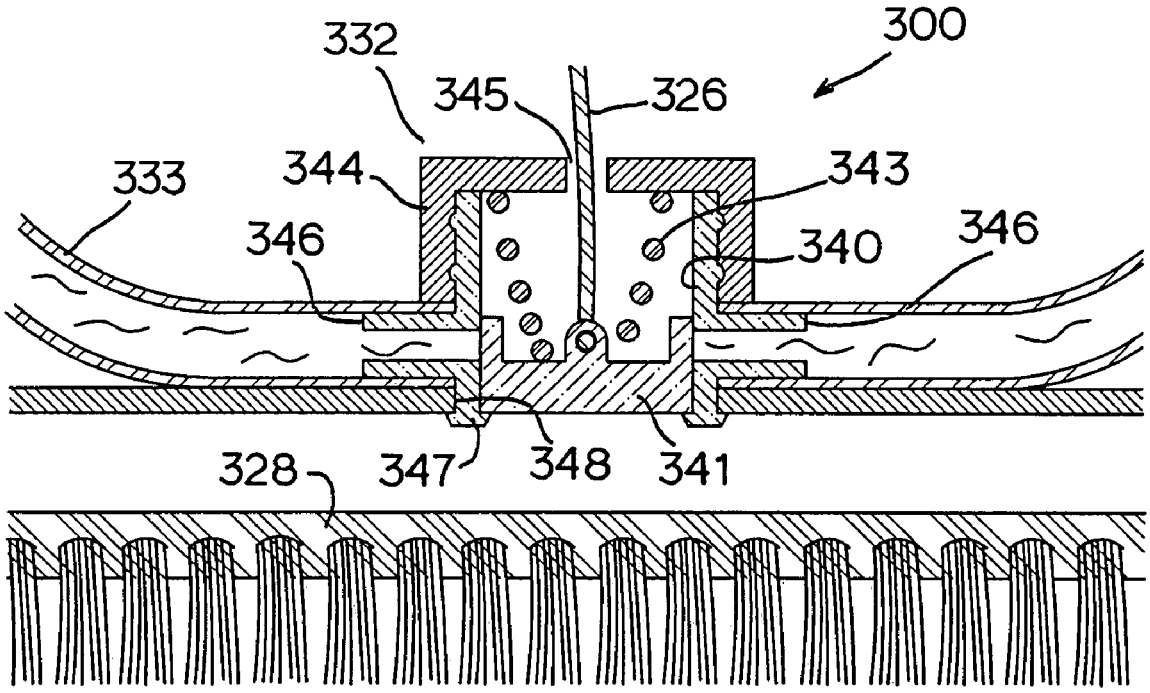
FIG. 8 is a cross sectional view of a valve block connected to the cleaning handle of FIG. 7.

Referring to FIG. 8, the valve block 332 comprises a cylinder 340, a valve core 341 slidably received in the cylinder 340 with a spring bias 343 and an upper housing 344 with a center hole 345 for the cable 326 to enter in order to make a connection with the valve core 341. The cylinder also has a pair of solution inlets 346 for fitting with the tubes 333 and a latching means 347 for holding itself in a center bore 348 formed in the base 328 of the sweeper 300.

While the presently preferred form of the bi-pole cleaning handle has been shown and described, and several modifications thereof discussed, persons skilled in this art will readily appreciate that various additional changes and modifications may be made without departing from the spirit of the invention, as defined and differentiated by the following claims.

| CALL OUT LIST OF ELEMENTS | |
|---|---|
| 10, 100, 300: | Floor Sweeper |
| 11, 111: | First Side Pole |
| 12, 112: | Second Side Pole |
| 14, 15: | Swivel Connector |
| 16: | First Side Support |
| 17: | Second Side Support |
| 18, 118: | Base |
| 19: | Cleaner Head |
| 20, 21, 24: | Handle |
| 22: | Grip |
| 23: | Pattern |
| 31: | Ball Joint Retainer |
| 32: | Upper Housing Member |
| 33: | Screw Holes |

-continued

| CALL OUT LIST OF ELEMENTS | |
|---|---|
| 34: | Ball Bearing |
| 36: | Ball Joint |
| 37: | Ball Member |
| 38: | Concave Area |
| 39: | Screw |
| 40: | Threaded Tip |
| 113: | Latch |
| 114: | Shoulder |
| 115: | Fibers |
| 116, 117: | Container Section |
| 119: | Base Block |
| 120: | Bottom Plate |
| 121: | Opening |
| 122: | Lid Member |
| 124: | Valve |
| 125: | Bias Spring |
| 126: | Cable |
| 127: | Actuation Lever |
| 128: | Grip |
| 130: | Horizontal Channel |
| 131: | Vertical Channel |
| 221: | Upright Walls |
| 222: | Central Opening |
| 223: | Convex Seat |
| 224: | Cleaning Solution |
| 301, 312: | Top Pole Section |
| 302: | Low Pole Section |
| 303: | Threaded End |
| 316: | Solution Container |
| 317: | Cylindrical Body |
| 318: | Central Sleeve |
| 319: | Outlet |
| 320: | Outer Thread |
| 321: | Shoulder |
| 322: | Lid |
| 323: | Opening |
| 326: | Cable |
| 327: | Pole-top Lever |
| 328: | Base |
| 329: | Cleaner Head |
| 330: | Solution Channel |
| 331: | Ball Joint Retainer |
| 332: | Valve Block |
| 333: | Tube |
| 340: | Cylinder |
| 341: | Valve Core |
| 343: | Spring |
| 344: | Upper Housing |
| 345: | Center Hole |
| 346: | Solution Inlet |
| 347: | Latching Means |
| 348: | Center Bore |

The invention claimed is:

1. A bi-pole handle cleaning instrument comprising:

a) a cleaning head;

b) a first pole having a first grip at its top end and a swivel joint at its bottom end to attach the first pole pivotally to the cleaning head;

c) a second pole having a second grip at its top end and a swivel joint at its bottom end to attach the second pole pivotally to the cleaning head;

d) mechanical engagement between the first grip and the second grip; whereby the two poles may be independently maneuvered and then optionally converged;

e) each said first pole and second pole comprising a fastening means comprising a ball joint retainer that includes an upper housing member with a number of screw holes and a ball housing located centrally of the housing member, wherein the ball housing protrudes upwardly from the housing member and has an opening through which a ball joint is inserted, wherein the ball joint is provided at its lower end with a ball member retained by the ball housing at an upper round area and by a support below.

2. The bi-pole handle cleaning instrument of claim 1, wherein the support has a concave area to receive a bottom of the ball member, wherein when the ball joint retainer is attached to the support by screws, it provides a threaded tip for fastening with the pole with a threaded bore at its bottom end.

3. The bi-pole handle cleaning instrument of claim 2, further comprising:

a. a first cleaning solution container mounted on the first pole and a second cleaning solution container mounted on the second pole;

b. a valve that acts with a bias spring to release liquid from the first cleaning solution container and the second cleaning solution container; and c. liquid channels disposed on the cleaning head and connecting to on a bottom plate also disposed on the cleaning head, wherein the cleaning head further comprises a central opening.

4. The bi-pole handle cleaning instrument of claim 3, further comprising a lever mounted at the first grip or the second grip, wherein the lever is configured to actuate the valve for liquid release.

5. The bi-pole handle cleaning instrument of claim 4, wherein the first pole is further comprised of a top pole section and a bottom pole section, wherein the first cleaning solution container is mounted between the top pole section of the first pole and the bottom pole section of the first pole, wherein the second pole is further comprised of a top pole section and a bottom pole section, wherein the second cleaning solution container is mounted between the top pole section of the second pole and the bottom pole section of the second pole.

6. The bi-pole handle cleaning instrument of claim 5, wherein the first cleaning solution container and the second cleaning solution container both include a cylindrical body and a central sleeve that forms a bottom of the first cleaning solution container and the second cleaning solution container, wherein the sleeve has a bottom where an outlet for solution is supplied from.

7. The bi-pole handle cleaning instrument of claim 6, wherein the cylindrical body has at a top edge an outer thread; and wherein the first cleaning solution container and the second cleaning solution container both have a lid detachable from the cylindrical body.

8. The bi-pole handle cleaning instrument of claim 7, wherein at a middle portion of a base, a valve block is attached and connected to a pole-top lever via a pull cable, wherein a pair of flexible tubes provide fluid flow.

* * * * *